United States Patent [19]

Tomasky

[11] 4,389,651

[45] Jun. 21, 1983

[54] TRIANGULAR ANTENNA

[76] Inventor: Philip P. Tomasky, 73 Warner Hill Rd., Southport, Conn. 06490

[21] Appl. No.: 260,373

[22] Filed: May 4, 1981

[51] Int. Cl.[3] ..... H01Q 9/28

[52] U.S. Cl. ..... 343/794; 343/846

[58] Field of Search ..... 343/773, 792, 795, 803, 343/804, 806, 829, 830, 846, 794, 828, 908

[56] References Cited

U.S. PATENT DOCUMENTS

| | | | |
|---|---|---|---|
| 2,175,253 | 10/1939 | Carter | 343/795 |
| 3,020,550 | 2/1962 | Beever | 343/795 |
| 3,262,121 | 7/1966 | Holloway | 343/773 |
| 3,501,767 | 3/1970 | Velez | 343/795 |

*Primary Examiner*—Eli Lieberman

*Attorney, Agent, or Firm*—Barry R. Lipsitz

[57] ABSTRACT

A coplanar, broadband antenna having a first triangle-shaped frame member and a radiator member situated adjacent and perpendicular to the bisector of one corner of the triangle-shaped frame. Additional triangle-shaped members may be provided in concentric relation to the first triangle member. The antenna may be constructed from conductive tape or paint affixed to a non-conducting substrate providing a lightweight, portable antenna suitable for mobile use.

11 Claims, 4 Drawing Figures

Fig. 1.
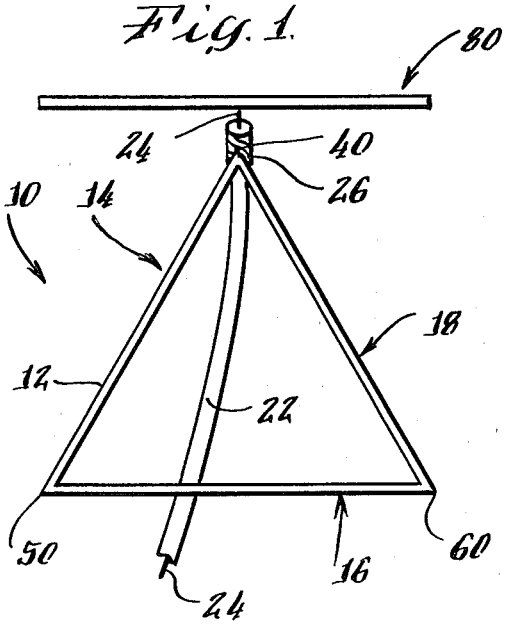
Fig. 2.
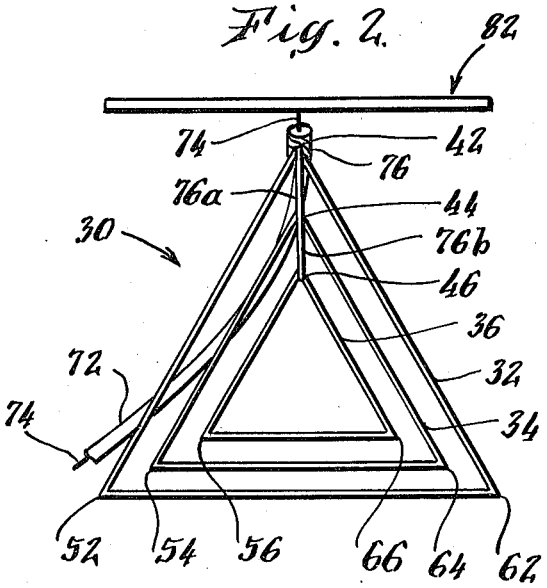
Fig. 3.
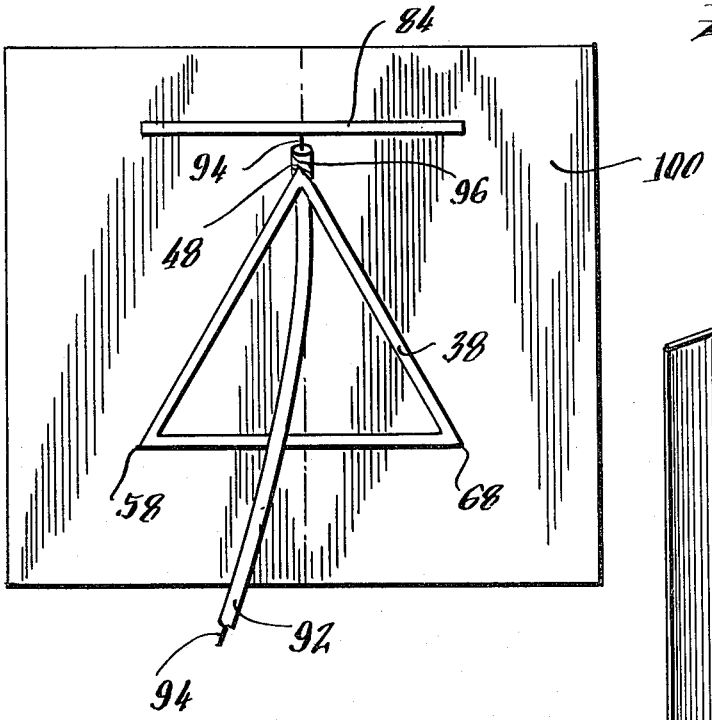
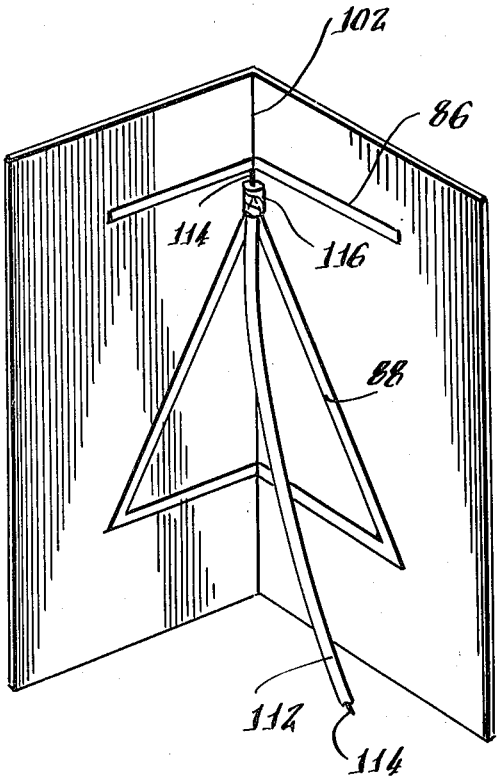
Fig. 4.

TRIANGULAR ANTENNA

BACKGROUND OF THE INVENTION

1. Field of the Invention

This invention generally relates to broadband antennas and more particularly to antennas used in the transmission and reception of radio frequencies in the VHF spectrum.

2. Description of the Prior Art

A radio antenna is the structure associated with the region of transition between a guided wave and free space, or vice-versa. In the past, many different types of antennas have been designed both to optimize the receipt and the transmission of radio signals. The antenna of the present invention deals primarily with the transmission and reception of VHF signals, but may be used in frequency bands other than VHF as well.

Many different types of antenna configurations are well known. Among these are dipole, loop, helical, biconical, cylindrical and linear antennas, as well as reflector-type, slot, horn and complementary antennas. Other types of antennas such as long wire antennas are also well known. Of particular importance in antennas for the transmission of radio signals is the pattern of radiation emitted from the antenna. It is preferable to have the maximum radiation be in the horizontal plane. A category of antennas known as ground plane antennas is particularly well suited to providing horizontal radiation. A complete technical discussion of ground plane as well as the other types of antennas mentioned can be found in a book entitled *Antennas*, by John D. Kraus, Ph.D., published by the McGraw-Hill Book Company, Inc.

One particular type of ground plane antenna is known as the discone antenna. A discone antenna is constructed by fabricating a cone of material such as wire screen and placing perpendicular to the apex thereof a disc also formed of wire screen. The discone antenna functions as a wide bandwidth, impedance matching transformer, coupling a low impedance transmission line to the higher impedance of free space. In the process it radiates with a pattern similar to that of a quarter-wavelength vertical antenna above a ground plane. Waves form at the feed point (apex) and travel on the antenna surface to the edges of the cone and disc.

While conventional discone antennas function well over a wide bandwidth, for example the 144, 220 and 420 megahertz bands, they suffer the disadvantage of being rather bulky and unless carefully constructed, subject to destruction by high winds. Further, discone antennas are not easily adaptable to mobile use.

It would be highly advantageous to have an antenna which exhibits the desirable electrical characteristics of the discone antenna but which is portable and suitable for use in automobiles, trucks and other such vehicles. The antenna should be compact, lightweight, and easy to install. Ideally, it would be inexpensive to manufacture.

SUMMARY OF THE INVENTION

The present invention provides an antenna which satisfies each of the aforementioned needs.

In particular, a triangularly shaped, broadband radio frequency antenna is disclosed. The antenna has an electrically conductive triangular-shaped frame member which may be constructed from either solid wire, tubing, or flat-conductive tape. A radiator member, preferably fabricated from the same material, is provided adjacent and perpendicular to the bisector of one corner of the triangular frame member. The radiator member is electrically insulated from the triangular-shaped frame member. Connector means is provided to electrically connect a coaxial cable to the radiator member and the frame member. In a preferred embodiment, the center conductor of the coaxial cable is connected to the radiator member. The shield, in turn, is connected to the triangular-shaped frame.

Although the antenna works quite well with a single triangular-shaped frame member, additional triangle frames may be added to the antenna, each succeeding additional triangle being placed in the same plane and in concentric relation to the one before it. The additional triangular members are electrically connected to each other and to the first triangular frame only through the group of corners that corresponds to the corner of the first triangle that is adjacent to the radiator member.

When the triangular and radiator members are fabricated from flat-conductive tape, a convenient portable antenna can be constructed by placing the tape on a flexible, nonconductive surface, such as a sheet of plastic. The resulting antenna will be lightweight, easy to roll up or fold, and convenient to carry. When unrolled or unfolded, the portable antenna may be placed in any convenient location. Satisfactory electrical performance is achieved even when the antenna is folded along its axis so that it may be hung within a corner.

BRIEF DESCRIPTION OF THE DRAWINGS

FIG. 1 is a front view of a triangular antenna with radiator constructed in accordance with the present invention.

FIG. 2 is a front view of an antenna having a plurality of triangular members, constructed in accordance with the present invention.

FIG. 3 shows an antenna constructed in accordance with the present invention in which the triangular frame and radiator member are fabricated from electrically conductive tape or paint affixed to a nonconductive, flexible sheet material.

FIG. 4 is an illustration of an antenna constructed in accordance with the present invention which has been mounted within a corner.

DETAILED DESCRIPTION OF THE INVENTION

As shown in FIG. 1, an antenna generally designated 10 comprises triangularly shaped frame member 12 having sides 14, 16 and 18. The three sides (14, 16 and 18) are each of equal length. In a preferred embodiment of the invention, radiator element 80 is equal in length to the wavelength of the signal to be received or transmitted divided by 4 ($\frac{1}{4}$ wavelength). Triangle sides 14, 16 and 18 are preferably of the same length as radiator element 80.

The signal is fed to antenna 10 in the transmitting mode through coaxial cable 22. Inner conductor 24 of coaxial cable 22 is connected to radiator element 80. The shield 26 of coaxial cable 22 is connected to the corner of triangle 12 which is adjacent radiator element 80. Both transmitted and received signals pass through coaxial cable 22, and specifically, the inner conductor 24 thereof.

Radiator element 80 is situated adjacent and perpendicular to the bisector of corner 40 of triangle 12. No electrical connection is made to the triangle corners 50 or 60.

As shown in FIG. 1, the triangle frame 12 and radiator member 80 are constructed of wire or tubing. The triangle and radiator members may alternatively be constructed of any conductive material, e.g. conductive tape or even conductive paint.

The geometry of the antenna of the present invention is substantially that of a coplanar cross-section of a discone antenna. In operation, the triangular antenna is quite similar to that of discone antenna operation. Thus, the antenna of the present invention functions as a wide-bandwidth, impedance-matching transformer. The antenna couples a low-impedance transmission line to the higher impedance of free space, radiating with a pattern similar to that of a quarter-wavelength vertical antenna above a ground plane. In operation, waves which form at the triangle point adjacent the radiator member, travel along the triangular frame toward the bottom of the antenna. It is preferable to choose the dimensions and geometry of the antenna so as to make the impedance at radiator member 80, as shown in FIG. 1, similar to the impedance of free space. This is so because maximum energy transfer occurs when impedances are matched.

The antenna of the present invention acts as a high-pass filter. The SWR (Standing Wave Ratio) increases rapidly below some cut-off frequency. SWR is the ratio of maximum current to minimum current (or maximum voltage to minimum voltage) along the transmission line. The greater this ratio, i.e., the greater the mismatch between the impedance of the antenna and that of free space, the higher the SWR. Above the cut-off frequency, the SWR of the antenna of the present invention remains low up to approximately ten times the cut-off value. Thus, above its cut-off frequency, the antenna is truly broadband in nature.

One antenna which has been fabricated in accordance with the present invention was designed to operate at an optimum frequency of 144 megahertz (MHz). For this antenna, the length of each of sides 14, 16 and 18 of antenna 12 was approximately 19 inches, which is equivalent to $\frac{1}{4}$ of the length of a single 144 MHz wave ($\frac{1}{4}$ wavelength). The length of radiator member 80 was also $\frac{1}{4}$ wavelength or approximately 19 inches. It has been found that the design frequency of an antenna constructed in accordance with the present invention is dependent on the length of the radiator member 80. Thus, for a given frequency of interest, the radiator member 80 should be $\frac{1}{4}$ of the wavelength of the frequency to be transmitted or received. Further, the distance from the radiator member 80 to the bottom side 16 of the triangular frame should be $\frac{1}{4}$ wavelength in length (for the 144 MHz band, approximately 19 inches). For a 144 MHz antenna so constructed, the SWR has been measured to be approximately 1.17:1.

Other embodiments of the triangular antenna are shown in FIGS. 2 through 4. The antenna of FIG. 2 is basically that of FIG. 1 with the addition of a plurality of smaller perimeter triangles 34, 36 concentric with main triangle 32. Additional triangles 34 and 36 are connected at corners 44 and 46, respectively, to the top corner 42 of main triangle 32. Corner 46 of triangle 36 is connected to corner 44 of triangle 34 by conductor **76*b*. Corner 44 of triangle 34 is connected to corner 42 of triangle 32 by conductor 76*a*. Triangles 32, 34 and 36 are not connected to each other at any point other than respective corners 42, 44 and 46. Corner 42 of triangle 32 is connected to shield 76 of coaxial cable 72 as shown. The center conductor 74 of coaxial cable 72 is conducted to radiator member 82. The length of radiator member 82 is $\frac{1}{4}$ wavelength of the design frequency. The distance between radiator member 82 and the side of triangle 32 which is parallel therewith, extending between corners 52 and 62, is also $\frac{1}{4}$ wavelength of the desired operating frequency. Each of triangles 32, 34 and 36 are equilateral triangles. Each side of triangle 32 will be $\frac{1}{4}$ wavelength of the desired operating frequency. The provision of additional triangles 34 and 36 to the basic antenna comprising triangle 32 and radiator member 82 provides greater gain for the overall antenna configuration. It is believed that the greater gain results from an additive or complementary effect resulting from the additional antenna elements. The only nulls that do occur, if any, are on the sides of the respective triangles 32, 34 and 36, resulting in an optimal radiation pattern both to and from radiator member 82. Coax 72** is typically a 50 ohm coax cable as commonly used for the transmission and reception of radio signals.

The embodiment of FIG. 3 shows a convenient portable antenna in accordance with the present invention. A flexible sheet 100 of nonconductive material such as plastic or cloth is provided as a substrate to carry the conductive elements of the antenna. Radiator element 84 and triangle member 38 are constructed from flat conductive tape affixed to flexible sheet 100. Alternatively, radiator element 84 and triangle 38 may be formed of conductive paint. Inner conductor 94 of coaxial cable 92 is connected to radiator member 84. Shield 96 of coaxial cable 92 is connected to triangle 38 at corner 48. The material used for flexible sheet 100 is limited only by the requirement that it have a dielectric strength high enough to withstand the radio frequency power inputted into the antenna by the transmitter. As will be understood by those skilled in the art, the free ends of the coaxial cables described in conjunction with the antenna configurations of the present invention are connected to the receiver and/or transmitter with which the antenna is being used.

The antenna embodiment shown in FIG. 3 can be rolled up and/or folded to provide a convenient-to-carry portable broadband antenna. In actual use it can be connectd to the receiver and/or transmitter and hung in any convenient location, e.g. by grommets 120 and 122.

It is not necessary that the antenna of the present invention be mounted in a single plane. It has been found that such an antenna will work quite well even if folded to fit within a corner as shown in FIG. 4. Referring to FIG. 4, an antenna is formed in accordance with the present invention having triangular member 88 and radiator member 86. Again, the inner conductor 114 of a coaxial cable 112 is connected to the radiator member 86. Coax cable shield 116 is connected to the top corner of triangle member 88. In one embodiment, the antenna may be constructed of electrically conductive tape and affixed to inside corner 102. Inside corner 102 may be one of the rear corners of a car or van. In the instance of a station wagon, corner 102 may be one of the inside rear corners adjacent the tailgate. It will be appreciated by those skilled in the art that the surfaces of a corner to which conductive tape forming an antenna in accordance with the present invention is affixed, must be nonconductive.

The above-described arrangements are merely illustrative of the principles of the present invention. Numerous modifications and adaptations thereof will be readily apparent to those skilled in the art without departing from the spirit and scope of the present invention.

What is claimed as new is as follows:

1. A broadband radio frequency antenna comprising:

an electrically conductive triangle-shaped first frame member;

a radiator rod electrically insulated from said frame member and situated adjacent and perpendicular to the bisector of one corner of said frame member; and connector means for electrically connecting an antenna cable to said radiator member and said frame member.

2. The antenna of claim 1 wherein said connector means connects the inner conductor of a coaxial cable to said radiator member and the conductive shield of said coaxial cable to said frame member.

3. The antenna of claim 1 wherein said first frame member and said radiator member are constructed of flat conductive tape.

4. A broadband radio frequency antenna comprising:

a triangle-shaped frame member constructed of electrically conductive tape or paint;

a rod-like radiator member constructed of electrically conductive tape or paint and electrically insulated from said frame member, said radiator member situated adjacent and perpendicular to the bisector of one corner of said frame member; and connector means for electrically connecting the inner conductor of a coaxial cable to said radiator member and the conductive shield of said coaxial cable to said frame member.

5. The antenna of claim 4 further comprising a flexible nonconductive coplanar medium to which the conductive tape or paint forming said frame member and said radiator member is affixed.

6. The antenna of claim 4 wherein said conductive tape or paint forming said frame member and said radiator member is affixed to a nonplanar, nonconductive surface.

7. A broadband radio frequency antenna comprising:

an electrically conductive triangle-shaped first frame member;

at least one additional triangle-shaped frame member concentric with and electrically connected to said first frame member;

radiator member electrically insulated from said frame member and situated adjacent and perpendicular to the bisector of one corner of said frame member; and connector means for electrically connecting an antenna cable to said radiator member and said frame members.

8. The antenna of claim 7 wherein said additional frame members are coplanar with and of increasingly smaller perimeter than said first frame member.

9. The antenna of claim 8 wherein said first and additional frame members and said radiator member are constructed of metal wire.

10. The antenna of claim 8 wherein said first and additional frame members and said radiator member are constructed of flat conductive tape.

11. The antenna of claim 8 wherein said additional frame members are aligned within and in the same direction as said first frame member whereby the corners of successive triangles correspond with one another, said additional frame members being electrically connected to each other and to said first frame member only through the group of corners that corresponds to the corner of said first frame member that is adjacent to said radiator member.

* * * * *